US006767608B1

(12) United States Patent
Salvaggio

(10) Patent No.: US 6,767,608 B1
(45) Date of Patent: Jul. 27, 2004

(54) GIFT BASKET STACKING TRAY

(76) Inventor: Anthony Salvaggio, 26401 Harbour Pointe Dr., Harrison Township, MI (US) 48045

( * ) Notice: Subject to any disclaimer, the term of this patent is extended or adjusted under 35 U.S.C. 154(b) by 0 days.

(21) Appl. No.: 10/304,188

(22) Filed: Nov. 25, 2002

Related U.S. Application Data

(60) Provisional application No. 60/377,549, filed on May 2, 2002.

(51) Int. Cl.[7] ..... B65D 1/34; B65D 65/28

(52) U.S. Cl. ..... 428/131; 428/43; 428/134; 428/542.2; 206/564; 206/820; 426/115

(58) Field of Search ..... 428/136, 43, 131, 428/134, 542.2, 542.4, 174, 180; 426/120, 115, 106, 108, 112, 119; 206/102, 198, 203, 518, 557, 558, 561, 562, 564, 457, 458, 820; 211/126.1; 294/144, 154, 172; 729/406, 407, 904, 120.11; 220/413, 234, 23.53, 23.56, 523, 556, 524.1, 575, 755, 784; 108/153.1, 157.1, 163.14; 221/302; 248/548, 929

(56) References Cited

U.S. PATENT DOCUMENTS 2,162,162 A * 6/1939 De Murguiondo ..... 249/61
3,021,695 A * 2/1962 Voigtmann ..... 249/127

* cited by examiner

*Primary Examiner*—Sandra M. Nolan
*Assistant Examiner*—Alicia Chevalier
(74) *Attorney, Agent, or Firm*—Fildes & Outland, P.C.

(57) ABSTRACT

A gift basket stacking tray includes a generally planer formed rigid sheet. Arcuately shaped depressions are disposed on the formed sheet and raised display platforms are disposed above the formed sheet. Perforated lines traverse the formed sheet between the arcuately shaped depressions and the raised display platforms. The perforated lines allow for flexible removal of sections of the stacking tray so that the tray can accommodate and/or be stacked on top of various sizes and shapes of fruits, bottles, boxes and the like within a gift basket.

7 Claims, 4 Drawing Sheets

14
14
14
14
14
16
18
16
12
14
14
18
10
14
14

GIFT BASKET STACKING TRAY

CROSS REFERENCE TO RELATED APPLICATION

This application claims the priority of provisional application No. 60/377,549 filed May 2, 2002.

TECHNICAL FIELD

This invention relates to gift baskets and more particularly a stacking tray or liner disposable within a gift basket that provides for the orderly placement and stacking of fruits and the like in the gift basket.

BACKGROUND OF THE INVENTION

Gift baskets have become an enjoyable gift to give and receive. Gift baskets can be individually tailored to include a myriad of items including fruits, snacks, cheeses, wines, etc. However, putting together a gift basket that includes a number of fruit pieces is often time consuming and labor intensive.

The conventional method of packing fruit in a gift basket includes providing a filler such as paper shreddings in the basket to protect the fruit, placing the fruit among the shredding within the basket and taping the fruit together and/or to the basket to maintain the placement of the fruit. The placement of fruit is complicated when the fruit is required to be stacked and the generally round surface of one fruit is placed on another fruit and sufficient tape has to be provided to anchor the fruit in a selected placement.

SUMMARY OF THE INVENTION

The present invention provides a stacking tray or liner for a gift basket that allows a plurality of fruit pieces or the like to be easily positioned therein and maintained in the placement without requiring tape and the associated labor.

The present invention also provides a stacking tray or liner for a gift basket that can be placed on top of a row of fruit or the like to establish another tier of fruit or the like.

More specifically, a stacking tray or liner in accordance with the invention includes a formed plastic or paper product material rigid sheet having a plurality of arcuately shaped depressions disposed therein for placing fruits or the like therein the depressions. The sheet material may include one or more raised platform display portions on which various products can be displayed. The sheet material includes selective lines of perforation between the depressions and/or the raised portions to allow easy separation of one part of the sheet material from another.

In one embodiment of the invention, the stacking tray or liner is an irregularly shaped, perforated, stacking tray with multiple peripherally disposed arcuately shaped depressions surrounding raised central platforms to allow the display of various products such as food or consumer goods in an appealing manner as to promote the sale and appeal of the products. The perforations allow flexibility for use of the tray whereby sections of an upper tray can be removed to permit tall display items such as pineapples or wine bottles to extend past the level of the second tray in the display basket. The strategically placed perforated break-away sections may be removed by quarter or half section, allowing a plurality of arrangements depending on the size of the basket and the fruits and/or products being displayed and the layering desired.

These and other features and advantages of the invention will be more fully understood from the following detailed description of the invention taken together with the accompanying drawings.

DETAILED DESCRIPTION OF THE INVENTION

Figure 1:
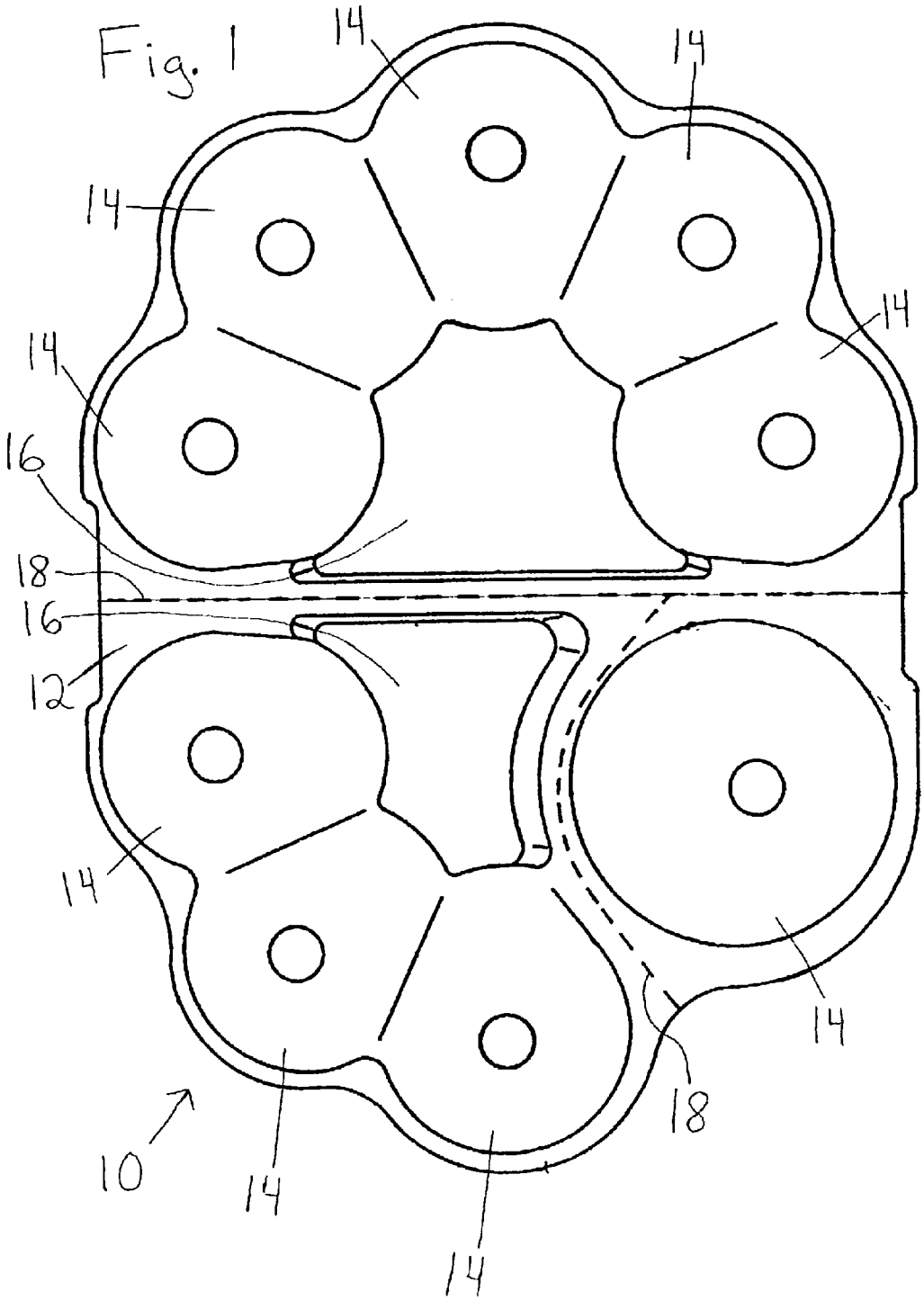
FIG. 1 is a plan view of a gift basket stacking tray in accordance with the invention having an irregular shape and including depressions and raised platforms.

Referring now to FIG. 1 of the drawings in detail, numeral 10 generally indicates a gift basket stacking tray in accordance with a first embodiment of the present invention. As is more fully hereinafter described, the gift basket stacking tray 10 provides for easier packing of fruits, snacks, wine bottles and other treats in a gift basket.

Figure 2:
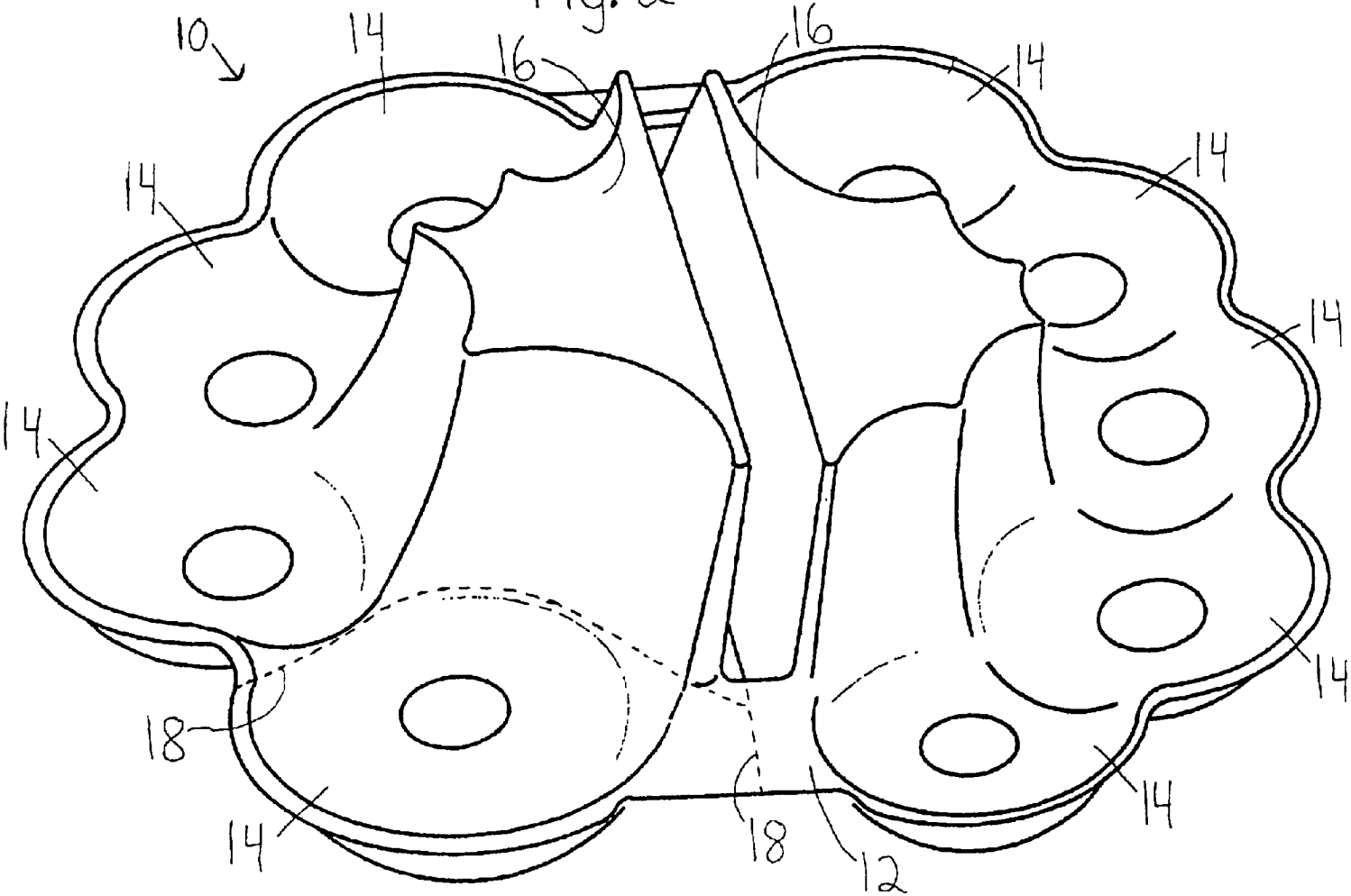
FIG. 2 is a perspective view of a gift basket stacking tray of FIG. 1.

As illustrated in FIGS. 1 and 2, a gift basket stacking tray 10 includes an irregularly shaped generally planer formed rigid sheet 12. A plurality of arcuately shaped depressions 14 are disposed along the periphery of the formed sheet 12. Two raised display platforms 16 are disposed in the center of the formed sheet 12. Perforated lines 18 traverse the formed sheet 12 between the arcuately shaped depressions 14 and the raised platforms 16.

In one arrangement sheet 12 comprises a plastic sheet formed by molding as is known in the art. Alternatively, sheet 12 comprises a paper based material which can be formed by conventional forming.

Figure 3A:
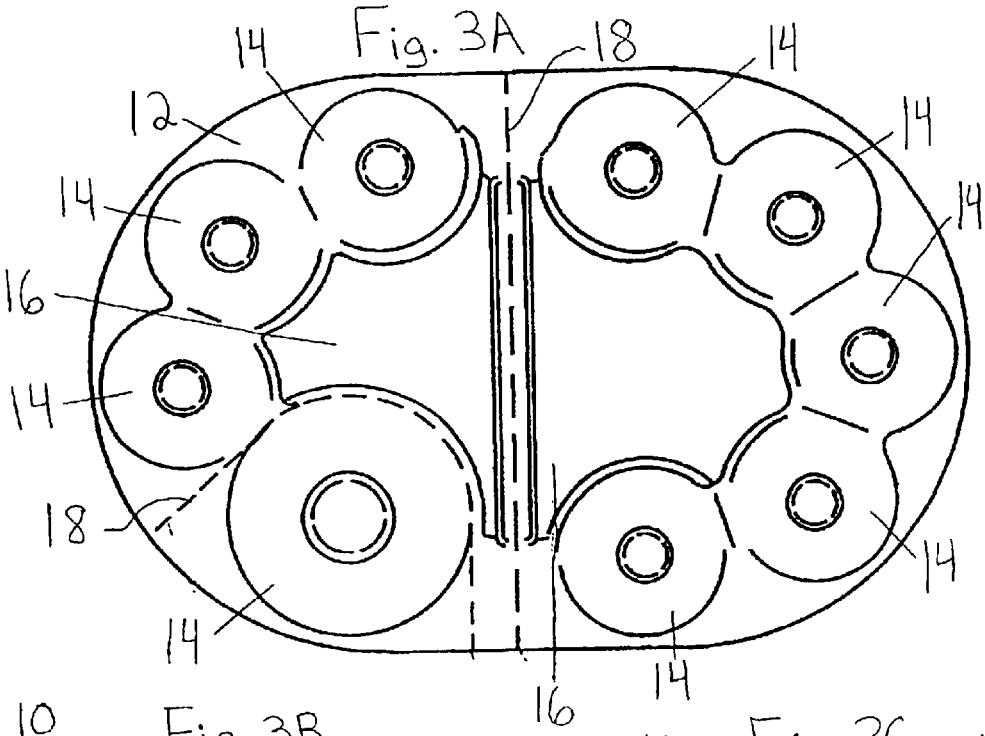
FIGS. 3A through 3D illustrate in plan view methods of separating the stacking tray of FIG. 1 into sections along perforated lines.
Figure 3B:
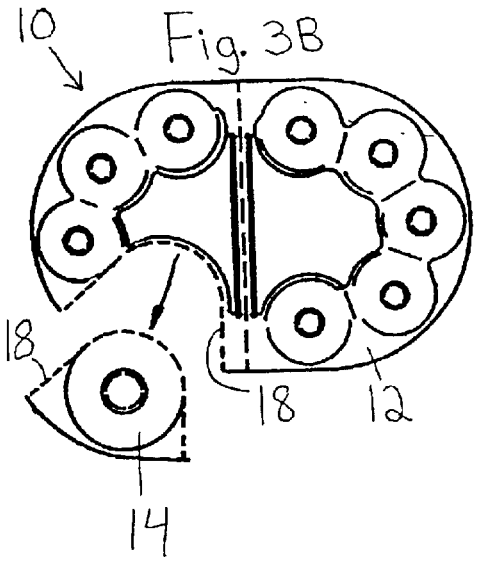
Figure 3C:
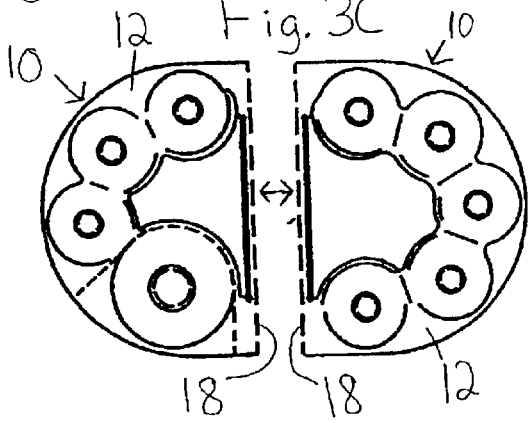
Figure 3D:
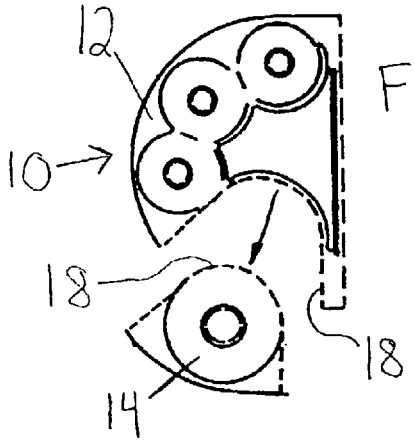

FIGS. 3A, 3B, 3C and 3D illustrate that the gift basket stacking tray 10 includes perforated lines 18 along which the tray can be separated to provide other shapes. In FIG. 3B, one of the arcuately shaped depressions 14 has been separated from formed sheet 12 along perforated line 18, leaving an open space or cut out in the stacking tray 10. In FIG. 3C, the formed sheet 12 has been separated in half along another perforated line 18, leaving two half-sections of the stacking tray 10. In FIG. 3D, one of the arcuately shaped depressions 14 has been separated from the formed sheet 12 along a perforated line 18 of a half-section of stacking tray 10, leaving an open space or cut out in a half-section of stacking tray 10.

Figure 4:
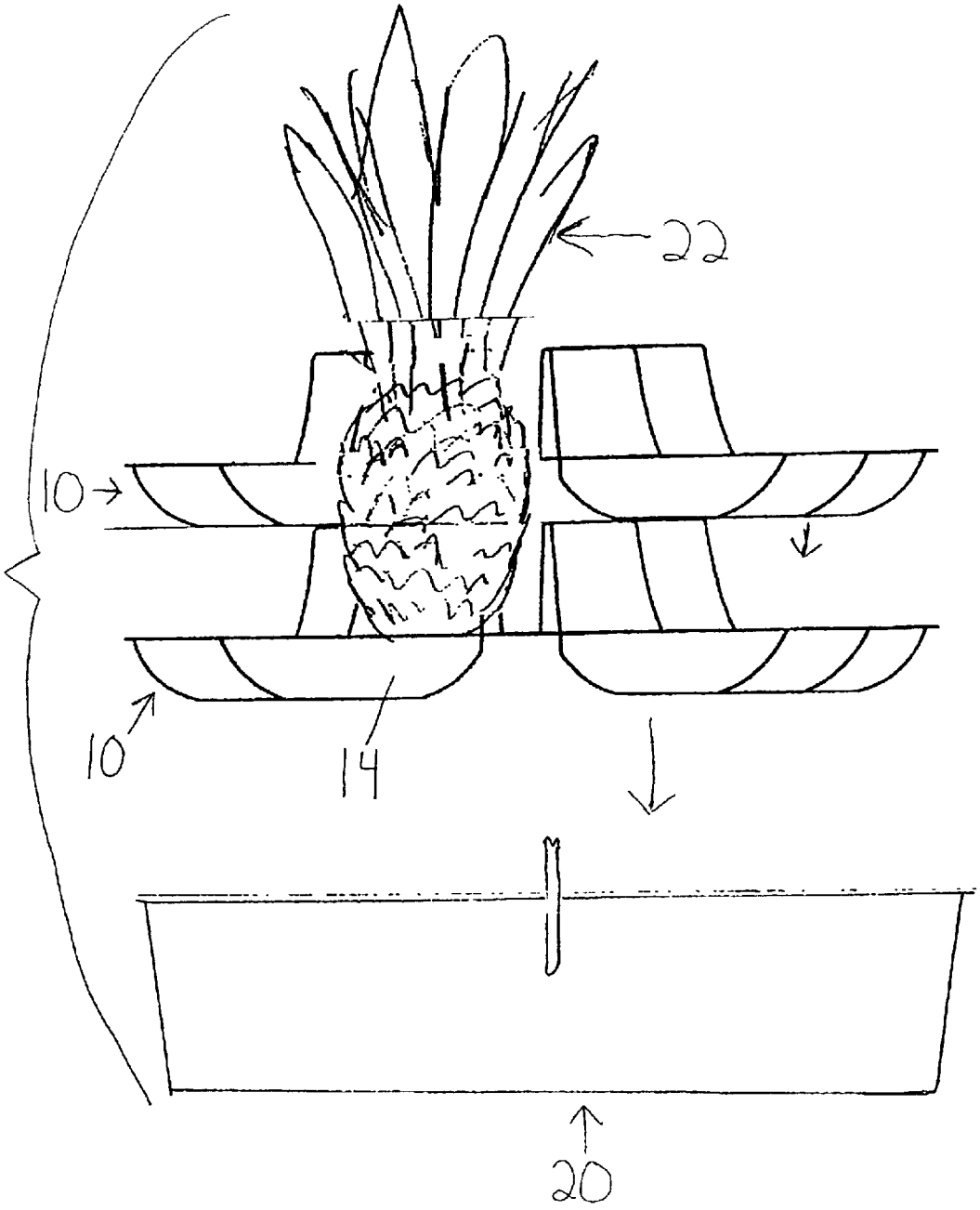
FIG. 4 is a schematic side view of two gift basket stacking trays according to the invention forming two tiers in a gift basket illustrating a tall item packed in a lower tier and extending through a cut-out portion in a second tier.

In FIG. 4, an advantage of the gift basket stacking tray 10 is shown. A first gift basket stacking tray 10 is placed in a gift basket 20 thereby defining a first tier for placement of fruits, treats and the like therein. A tall piece of fruit 22 is set in one of the arcuately shaped depressions 14 of the first stacking tray 10. A second gift basket stacking tray 10 is stacked on top of the first stacking tray 10 and/or the contents of the first stacking tray. One of the arcuately shaped depressions 14 has been removed from the second stacking tray 10 to create an open space or cut out for the tall piece of fruit 22 to extend through.

In accordance with the invention, stacking tray 10 provides flexibility for packing items of different heights in a basket as well as the flexibility of easily configuring or adapting to the size of the basket to be packed all resulting in an appealing presentation.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A stacking tray comprising:

a formed generally plan a rigid sheet;

said sheet comprising a plurality of arcuately shaped depressions disposed therein;

said sheet further comprising at least one raised, generally plan a display platform;

each of said at least one display platform having a surface area at least as large as that of an opening of one of the arcuately shaped depressions; and said sheet comprising perforations that traverse said sheet along lines between said arcuately shaped depressions and said at least one raised display platform, said perforations allow separation of said arcuately shaped depressions from said at least one raised display platform.

2. The stacking tray of claim 1, wherein the arcuately shaped depressions are disposed adjacent a periphery of the formed sheet.

3. The stacking tray of claim 1, wherein said at least one raised display platform is disposed about an inner portion of the formed sheet.

4. The stacking tray of claim 1, wherein the formed sheet has an irregular shape.

5. The stacking tray of claim 4 whereby said stacking tray is configurable and placeable in a gift basket to easily be packed with gift items.

6. The stacking tray of claim 1, wherein the formed sheet comprises a plastic sheet.

7. The stacking tray of claim 1, wherein the formed sheet comprises a paper product sheet.

* * * * *